US006209294B1

(12) United States Patent
Hibari

(10) Patent No.: US 6,209,294 B1
(45) Date of Patent: Apr. 3, 2001

(54) COIN WRAPPING MACHINE

(75) Inventor: Eikou Hibari, Kazo (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/111,071

(22) Filed: Jul. 7, 1998

(30) Foreign Application Priority Data

Jul. 18, 1997 (JP) ..... 9-194645
Jul. 2, 1998 (JP) ..... 10-187228

(51) Int. Cl.[7] ..... B65B 11/04; B65B 57/10; B65B 57/20

(52) U.S. Cl. ..... 53/493; 53/212; 53/498; 53/500; 453/31; 453/32

(58) Field of Search ..... 53/500, 493, 494, 53/495, 498, 53, 54, 212, 587, 532, 254; 453/31, 30, 32, 58, 59, 61, 17, 10

(56) References Cited

U.S. PATENT DOCUMENTS

| | | | | |
|---|---|---|---|---|
| 4,409,773 | | 10/1983 | Bergman et al. | 53/54 |
| 5,105,601 | * | 4/1992 | Horiguchi et al. | 53/212 X |
| 5,499,483 | * | 3/1996 | Oikawa | 53/212 X |
| 5,514,034 | * | 5/1996 | Jones et al. | 453/10 |
| 5,718,625 | * | 2/1998 | Bointon | 453/17 |

FOREIGN PATENT DOCUMENTS

| | | |
|---|---|---|
| 0 660 278 A1 | 6/1995 | (EP) . |
| 5-298521 | 11/1993 | (JP) . |
| 8-273024 | 10/1996 | (JP) . |
| WO 94/28520 | 12/1994 | (WO) . |

* cited by examiner

*Primary Examiner*—James F. Coan
(74) *Attorney, Agent, or Firm*—Frishauf, Holtz, Goodman, Langer & Chick, P.C.

(57) ABSTRACT

A coin wrapping machine including a coin stacking section for stacking deposited coins, a coin wrapping section for wrapping coins stacked by the coin stacking section and a coin supporting post for supporting the stacked coins and moving them from the coin stacking section to the coin wrapping section, the coin wrapping machine further including a light projector disposed between the coin stacking section and the coin wrapping section for projecting light onto the stacked coins being moved from the coin stacking section to the coin wrapping section, a line sensor disposed between the coin stacking section and the coin wrapping section for photoelectrically detecting light impinging onto the stacked coins from the light projector and reflected by edges of the stacked coins and a CPU for detecting portions between adjacent coins based on detection data produced by the line sensor, thereby determining the number of the stacked coins supported by the coin supporting post. According to the thus constituted coin wrapping machine, it is possible to reliably produce wrapped coin rolls each including a predetermined number of coins with compact structure.

12 Claims, 6 Drawing Sheets

COIN WRAPPING MACHINE

BACKGROUND OF THE INVENTION

The present invention relates to a coin wrapping machine which is compact and can reliably produce wrapped coin rolls each including a predetermined number of coins.

DESCRIPTION OF THE PRIOR ART

Coin wrapping machines are generally constituted so as to stack a predetermined number of coins in a coin stacking section, feed the thus stacked coins to a coin wrapping section and wrap them. In order to ensure that the predetermined number of coins is always wrapped, the number of coins fed to the coin stacking section is counted by a sensor and when the predetermined number of coins to be wrapped have been fed to the coin stacking section, a stopper prevents the following next coin from being fed to the coin stacking section.

However, when the coins detected by the sensor are not stacked in the coin stacking section in the proper manner, the number of coins wrapped may be less than the predetermined number and, on the other hand, when the stopper mulfunctions, coins whose number exceeds the predetermined number are fed to the coin stacking section and the number of coins wrapped may be more than the predetermined number. A coin wrapping machine having means for detecting whether the predetermined number of coins to be wrapped have been stacked in the coin stacking section has therefore been proposed.

Japanese Patent Application Laid open No. 5-298521 proposes a coin wrapping machine constituted so as to project light onto the edges of the coins stacked in the coin stacking section and fed to the coin wrapping section, detect reflected light by a CCD (Charge Coupled Device), detect gaps between adjacent stacked coins based on a detection signal of the CCD and count the number of gaps, thereby detecting the number of coins to be wrapped.

However, guide members are provided between wrapping rollers and the coins to be wrapped for guiding wrapping paper in a coin wrapping section so as to reliably guide the wrapping paper even when coins having the smallest diameter among coins to be wrapped are wrapped. Therefore, it is extremely difficult to secure space for disposing the CCD and if the CCD is provided, the coin wrapping machine inevitably becomes large.

It is therefore an object of the present invention is to provide a coin wrapping machine which is compact and can reliably produce wrapped coin rolls each including a predetermined number of coins.

SUMMARY OF THE INVENTION

The above other objects of the present invention can be accomplished by a coin wrapping machine comprising coin stacking means for stacking deposited coins, coin wrapping means for wrapping coins stacked by the coin stacking means and stacked coin moving means for supporting the stacked coins and moving them from the coin stacking means to the coin wrapping means, said coin wrapping machine further comprising light projecting means disposed between the coin stacking means and the coin wrapping means for projecting light onto the stacked coins being moved from the coin stacking means to the coin wrapping means, light detecting means disposed between the coin stacking means and the coin wrapping means for photoelectrically detecting light impinging onto the stacked coins from the light projecting means and reflected by edges of the stacked coins and coin number determining means for detecting portions between adjacent coins based on detection data produced by the light detecting means, thereby determining the number of the stacked coins supported by the stacked coin moving means.

In a preferred aspect of the present invention, the light projecting means and the light detecting means are disposed in the same horizontal plane.

In a further preferred aspect of the present invention, the light detecting means comprises a plurality of light receiving elements disposed horizontally.

In a further preferred aspect of the present invention, the coin number determining means is constituted so as to binarize the detection data produced by the light detecting means and detect the portions between adjacent coins based on the thus binarized data.

In a further preferred aspect of the present invention, the coin number determining means is constituted so as to judge whether light detected by the light detecting means was reflected by an edge of a stacked coin in accordance with reference data produced based on thickness of the thickest coins to be wrapped.

The above and other objects and features of the present invention will become apparent from the following description made with reference to the accompanying drawings.

DESCRIPTION OF THE PREFERRED EMBODIMENT

Figure 1:
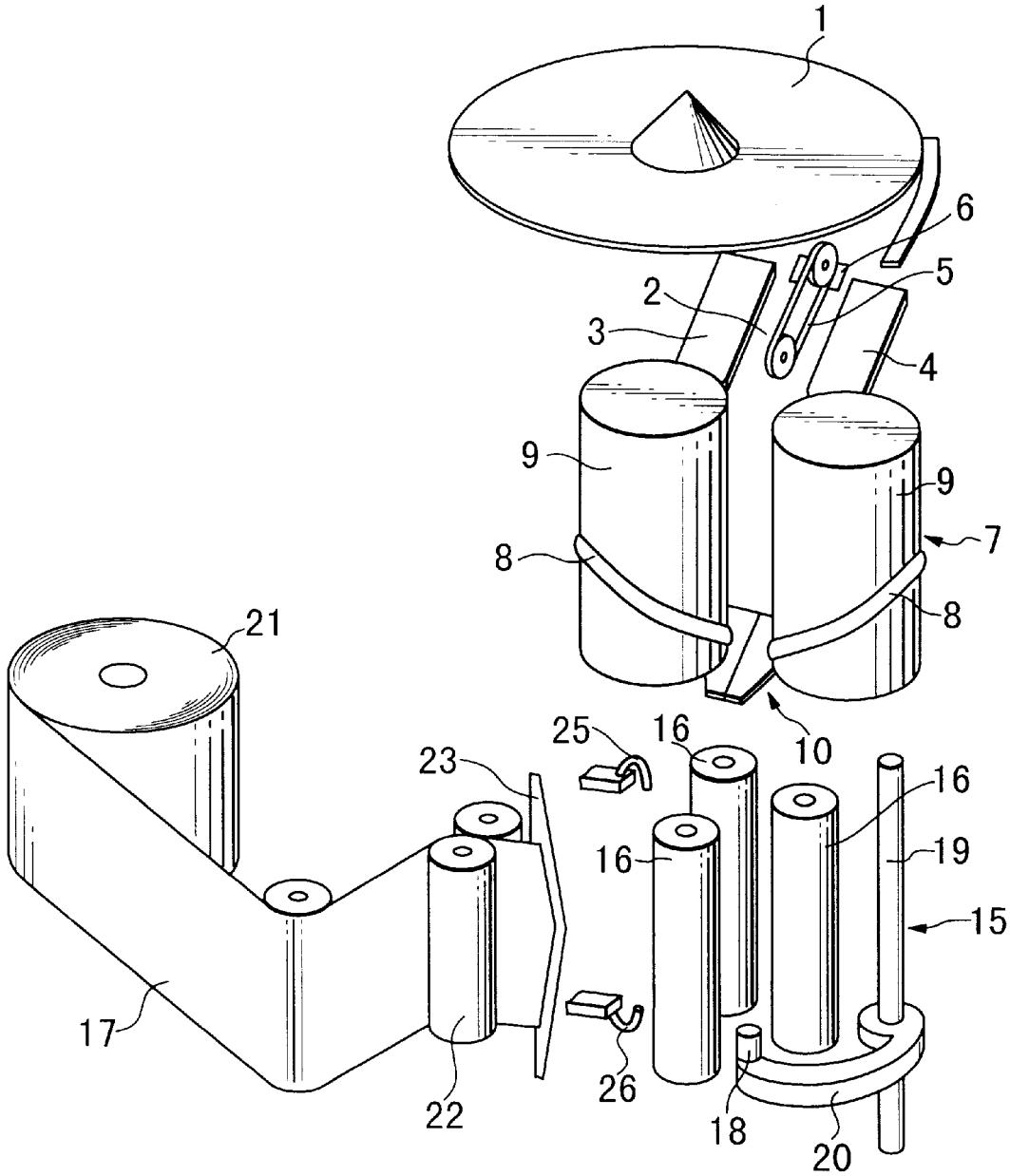
FIG. 1 is a schematic perspective view showing the internal mechanism of a coin wrapping machine which is an embodiment of the present invention.

As shown in FIG. 1, a coin wrapping machine which is an embodiment of the present invention is constituted so as to wrap coins of a specified denomination. Coins deposited into the coin wrapping machine through a coin depositing opening (not shown) are transported by a conveyor belt (not shown) and fed onto a rotatable disk 1. As well known in the art, an annular guide member (not shown) is disposed at the circumferential portion of the rotatable disk 1 and a coin sorting passage 2 is connected to an opening portion of the annular guide member.

The coin sorting passage 2 is formed by a pair of guide members 3, 4 and a conveyor belt 5 and the clearance between the pair of guide members 3, 4 is adjustable so that only coins of a denomination to be wrapped pass through the coin sorting passage 2, that coins having a larger diameter than that of the denomination of coins to be wrapped remain on the rotatable disk 1 and that coins having a smaller diameter than that of the denomination of coins to be wrapped drop between the pair of guide members 3, 4 to be collected. A sensor 6 is provided in the coin sorting passage 2 for discriminating coin denominations and counting the number of coins, and a stopper (not shown) is provided in the vicinity of the downstream end portion of the coin sorting passage 2 to be projectable into the coin sorting passage 2 for stopping the transportation of the following coins.

A coin stacking section 7 is provided downstream of the coin sorting passage 2 and is provided with a pair of stacking drums 9. The outer surface of each stacking drum 9 is formed with a spiral projection 8 for supporting coins on the upper surface thereof. Coin guide members (not shown) are respectively provided immediately upstream and immediately downstream of the pair of stacking drums 9 with respect to the transportation direction of coins in the coin sorting passage 2 for guiding coins so as to stack them on the spiral projections 8, and a shutter 10 is provided immediately below the pair of stacking drums 9 so that stacked coins can be placed thereon.

A coin wrapping section 15 is provided below the coin stacking section 7. The coin wrapping section 15 comprises three wrapping rollers 16 and a coin supporting post 18. The coin supporting post 18 can be moved between a waiting position immediately below the shutter 10, a wrapping position where coins stacked in the coin stacking section 7 are wrapped by winding wrapping paper 17 around the stacked coins by the wrapping rollers 16 and a retracted position below the wrapping position, and can support the stacked coins thereon. The coin supporting post 18 is provided in the vicinity of the tip end of an arm 20 movable along a support shaft 19 by a cam motor (not shown).

The coin wrapping section 15 further includes a wrapping paper roll 21 consisting of wrapping paper, a wrapping paper feeding roller 22 for feeding wrapping paper from the wrapping paper roll 21 to between the three wrapping rollers 16 and a cutter 23 disposed between the wrapping paper feeding roller 22 and the three wrapping rollers 16 for cutting the wrapping paper 17. The coin wrapping section 15 further includes wrapping paper guide members (not shown) for guiding and feeding the wrapping paper 17 to between the stacked coins supported on the coin supporting post 18 located at the wrapping position and the wrapping rollers 16.

Above the wrapping rollers 16, an upper crimp claw 25 is provided for crimping the upper end portion of the wrapping paper 17 wound around the stacked coins and below the wrapping rollers 16, a lower crimp claw 26 is provided for crimping the lower end portion of the wrapping paper 17 wound around the stacked coins.

Below the wrapping rollers 16, a gate is provided for separately guiding wrapped coin rolls produced in the coin wrapping section 15 to a wrapped coin roll box (not shown) via a chute (not shown) and coins which were not wrapped in the coin wrapping section 15 to a collecting box (not shown).

Figure 2:
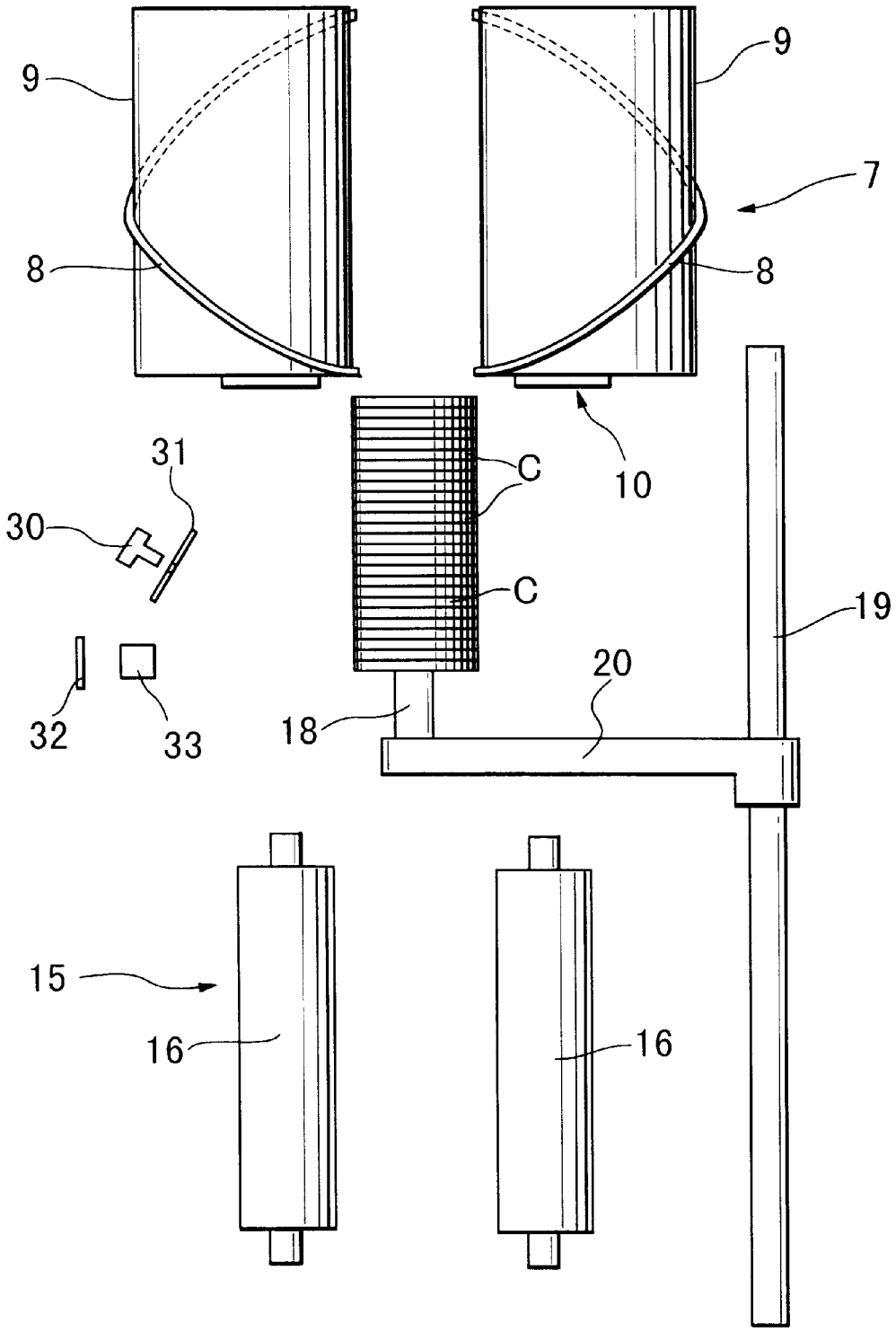
FIG. 2 is a schematic side view of a coin stacking section and a coin wrapping section.

FIG. 2 is a schematic side view of the coin stacking section 7 and the coin wrapping section 15.

Figure 3:
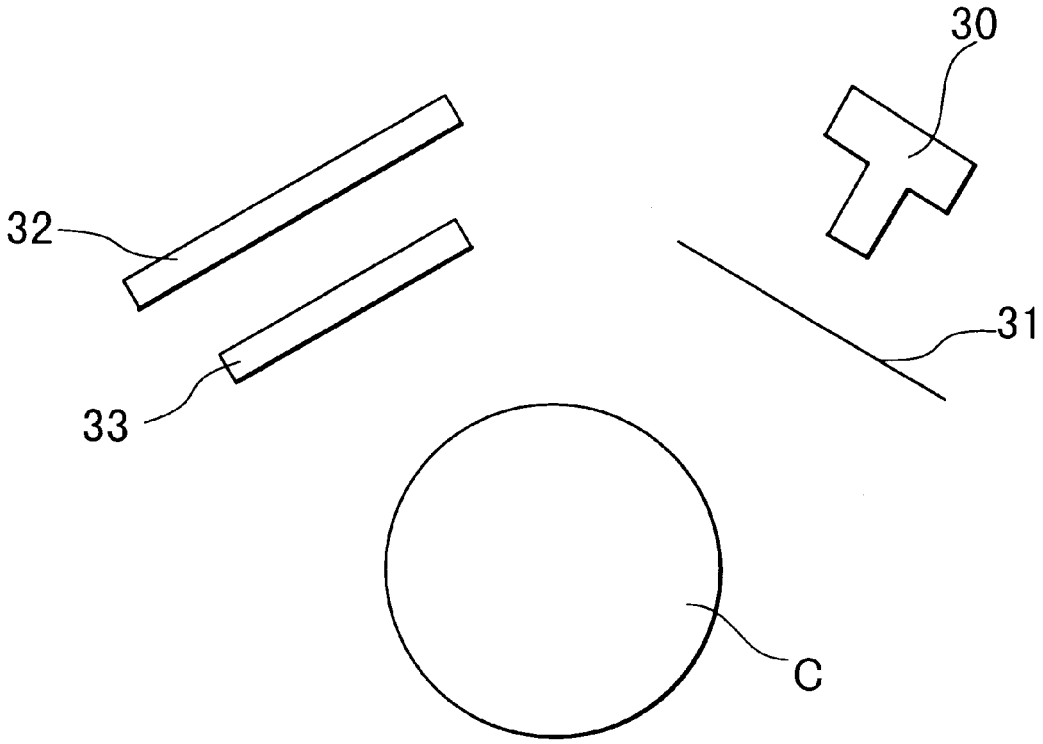
FIG. 3 is a schematic plan view showing the arrangement of a light source, a slit, a cylindrical lens and a line sensor.

As shown in FIG. 2, between the shutter 10 of the coin stacking section 7 and the wrapping rollers 16, a light source 30 is provided for emitting light through a slit 31 onto the stacked coins supported on the coin supporting post 18 and lowered toward the wrapping rollers 16 as the coin supporting post 18 is being lowered and a line sensor 32 is provided for receiving light emitted from the light source 30 and reflected from the edges of the stacked coins. In front of the line sensor 32, a cylindrical lens 33 is provided with its axis disposed horizontally. Of the light reflected from the edges of the stacked coins, the cylindrical lens 33 converges only the light in the horizontal direction onto the light receiving elements of the line sensor 32. For convenience of illustration, FIG. 2 shows the light source 30, the slit 31, the line sensor 32 and the cylindrical lens 33 are located at different levels in the vertical direction. However, as shown in FIG. 3, they are actually disposed in the same horizontal plane. The line sensor 32 has a plurality of light receiving elements arranged horizontally.

The light source 30, the slit 31, the line sensor 32 and the cylindrical lens 33 are adapted for detecting the number of coins supported by the coin supporting post 18.

Figure 4:
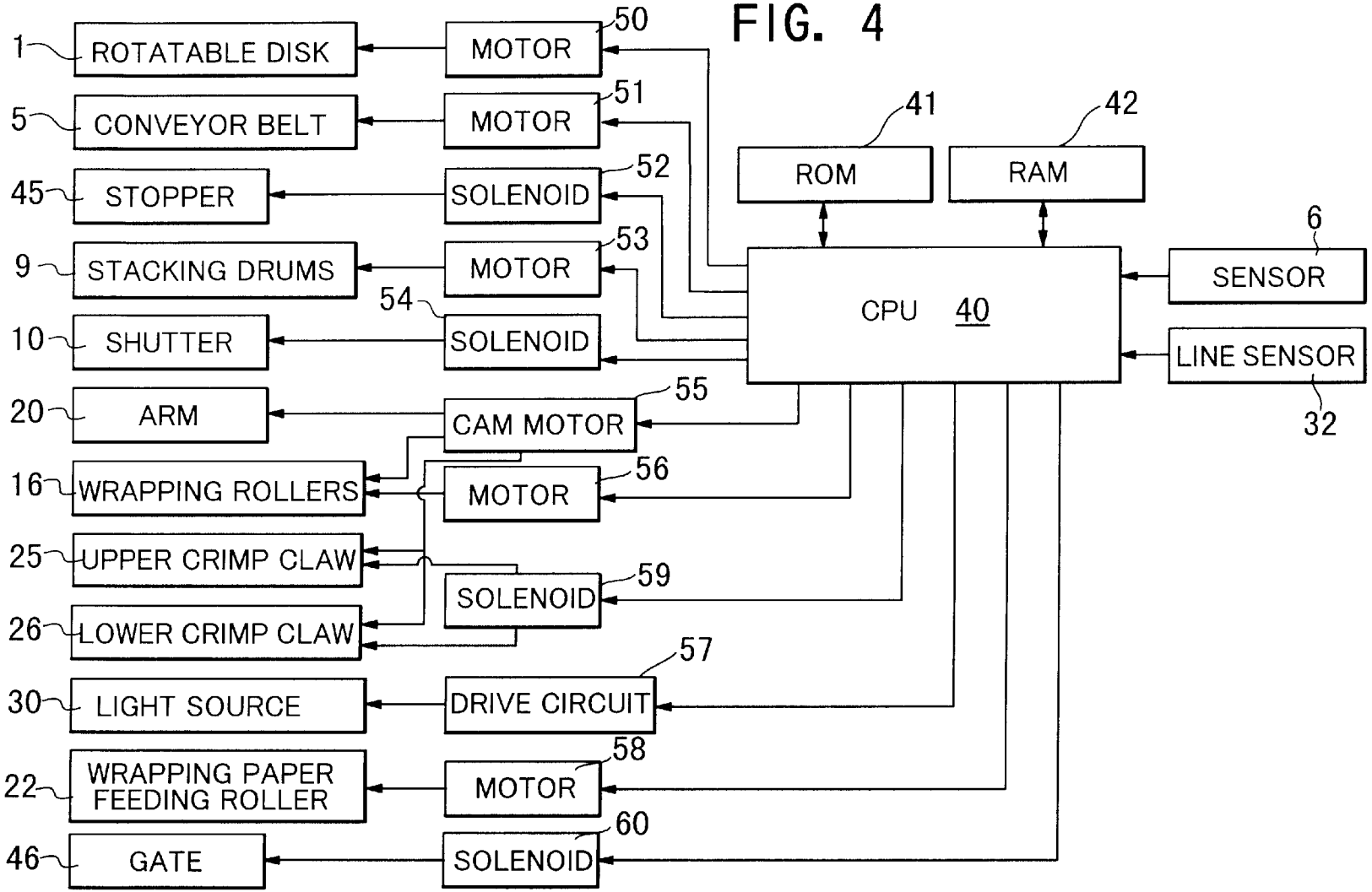
FIG. 4 is a block diagram of the control system, detecting system and driving system of a coin wrapping machine.

FIG. 4 is a block diagram of the control system, the detecting system and the driving system of a coin wrapping machine.

As shown in FIG. 4, the control system of the coin wrapping machine includes a CPU 40 for controlling the operation of the coin wrapping machine, a ROM 41 for storing a control program and a RAM 42 for temporarily storing various data. The detecting system of the coin wrapping machine includes the sensor 6 for discriminating coins and counting the number thereof and the line sensor 32 for receiving light reflected from the edges of coins supported on the coin supporting post 18. The driving system of the coin wrapping machine includes a motor 50 for rotating the rotatable disk 1, a motor 51 for driving the conveyor belt 5, a solenoid 52 for driving the stopper 45 provided in the vicinity of the downstream end portion of the coin sorting passage 2, a motor 53 for rotating the pair of stacking drums 9, a solenoid 54 for opening and closing the shutter 10 of the coin stacking section 7, a cam motor 55 for vertically moving the arm 20 provided with the coin supporting post 18 at the tip end portion thereof, moving the wrapping rollers 16 and moving the upper crimp claw 25 and the lower crimp claw 26 to between the wrapping rollers 16 and toward the upper and lower surfaces of stacked coins, a motor 56 for rotating the wrapping rollers 16, a drive circuit 57 for turning the light source 30 on and off, a motor 58 for driving the wrapping paper feeding roller 22, a solenoid 59 for preventing the upper crimp claw 25 and the lower crimp claw 26 from moving to and between the wrapping rollers 16 even when the cam motor 55 is driven, and a solenoid 60 for driving a gate 46 adapted to separately collect wrapped coin rolls and coins which were not wrapped.

The thus constituted coin wrapping machine which is an embodiment of the present invention wraps a predetermined number of coins and produces wrapped coin rolls in the following manner.

When an operator inputs a wrapping instruction signal to the coin wrapping machine, the wrapping instruction signal is fed to the CPU 40. When the CPU 40 receives the wrapping instruction signal, it outputs driving signals to the motor 50 and the motor 51, thereby rotating the rotatable disk 1 and driving the conveyor belt 5.

Coins deposited through a coin depositing opening (not shown) into the coin wrapping machine are transported by a conveyor belt (not shown) to be fed onto the rotating rotatable disk 1. The coins fed onto the rotatable disk 1 are fed along the annular guide member (not shown) by the centrifugal force produced by the rotation of the rotatable disk 1 and fed out to the coin sorting passage 2 one by one through the opening of the annular guide member. The clearance between the pair of guide members 3, 4 is set so that coins having a larger diameter than that of coins of denomination to be wrapped cannot pass the clearance between the pair of guide members 3, 4. Therefore, the coins having a larger diameter than that of coins of the denomination to be wrapped remain on the rotatable disk 1 and only the coins of the denomination to be wrapped and coins having a smaller diameter than that of coins of the denomination to be wrapped are fed one by one into the coin sorting passage 2.

Since the clearance between the pair of guide members 3, 4 is further set to be greater than the diameter of coins whose diameter is smaller than that of coins of the denomination to be wrapped, coins having a diameter smaller than that of coins of the denomination to be wrapped drop through the clearance between the pair of guide members 3, 4 to be collected.

The coins fed into the coin sorting passage 2 and which are of the denomination to be wrapped are discriminated by the sensor as to the denomination thereof and the number thereof is counted by the sensor 6. The coins are then fed toward the coin stacking section 7 in the coin sorting passage 2. A detection signal and a count signal are forwarded to the CPU 40 and when the CPU 40 receives the detection signal and the count signal, it stores the results of the detection and the count made by the sensor 6 in the RAM 42. The CPU 40 simultaneously drives the motor 53 based on the number of coins to be stacked in the coin stacking section 7 so as to set the vertical position of the spiral projections 8 formed on the side surfaces of the pair of stacking drums 9.

When the CPU 40 judges based on the result of the count made by the sensor 6 that the predetermined number of coins to be wrapped have been fed into the coin stacking section 7, it outputs a driving signal to the solenoid 52 to cause the stopper 45 to project into the coin sorting passage 2, thereby preventing subsequent coins from being fed into the coin stacking section 7. Simultaneously, the CPU 40 outputs driving signals to the motor 50 and the motor 51, thereby stopping the rotation of the rotatable disk 1 and the drive of the conveyor belt 5. The CPU 40 simultaneously outputs driving signals to the motor 53 and the cam motor 55 for a predetermined time period, whereby the coin supporting post 18 is started moving toward the waiting position immediately below the shutter 10.

The coins fed into the coin stacking section 7 are supported by the upper surface of the spiral projections formed on the outer surfaces of the pair of stacking drums 9. In accordance with the rotation of the stacking drums 9, coins sequentially fed into the coin stacking section 7 are stacked on the upper surface of the spiral projections while they are guided by the coin guide members (not shown). When the predetermined number of coins to be wrapped have been stacked on the outer surfaces of the pair of stacking drums 9 and lowered to the vicinity of the shutter 10, the coins are delivered onto the shutter 10.

When a predetermined time period has passed after the stopper 45 was driven and the CPU 40 judges that the stacked coins have been delivered onto the shutter 10 and the coin supporting post 18 has reached the waiting position, the CPU 40 outputs a driving signal to the solenoid 54 to open the shutter 10, thereby delivering the stacked coins placed on the shutter 10 to the upper surface of the coin supporting post 18 located at the waiting position.

The CPU 40 then outputs a driving signal to the cam motor 55, thereby lowering the arm 20 along the support shaft 19 and outputs a driving signal to the drive circuit 57, thereby turning the light source 30 on.

Light emitted from the light source 30 passes through the slit 31, thereby being transformed into a beam thin in the vertical direction and impinges on the edges of the stacked coins. The light reflected by the edges of the stacked coins enters the cylindrical lens 33 disposed with its axis directed horizontally. As a result, only a horizontal component of the reflected light is converged onto the horizontally arranged light receiving elements of the line sensor 32 and received thereby.

Figure 5A:
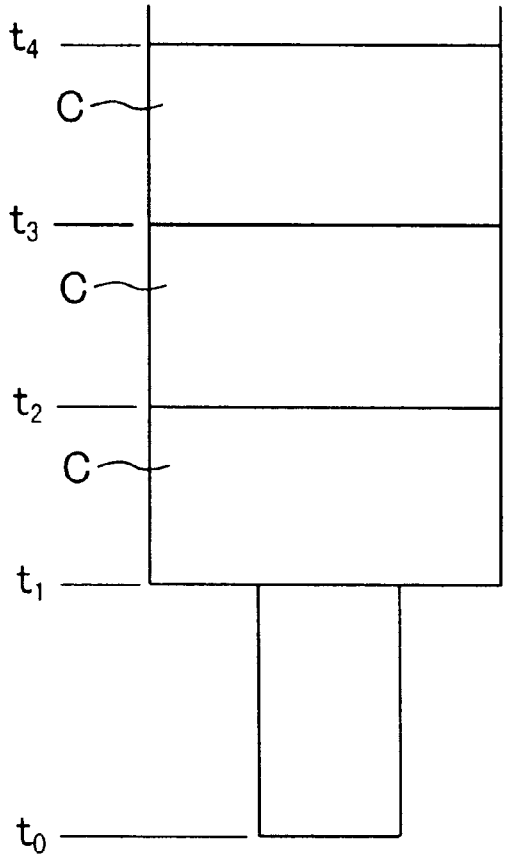
FIGS. 5A and 5B are diagrams showing how a line sensor produces a detected wave with respect to stacked coins.
Figure 5B:
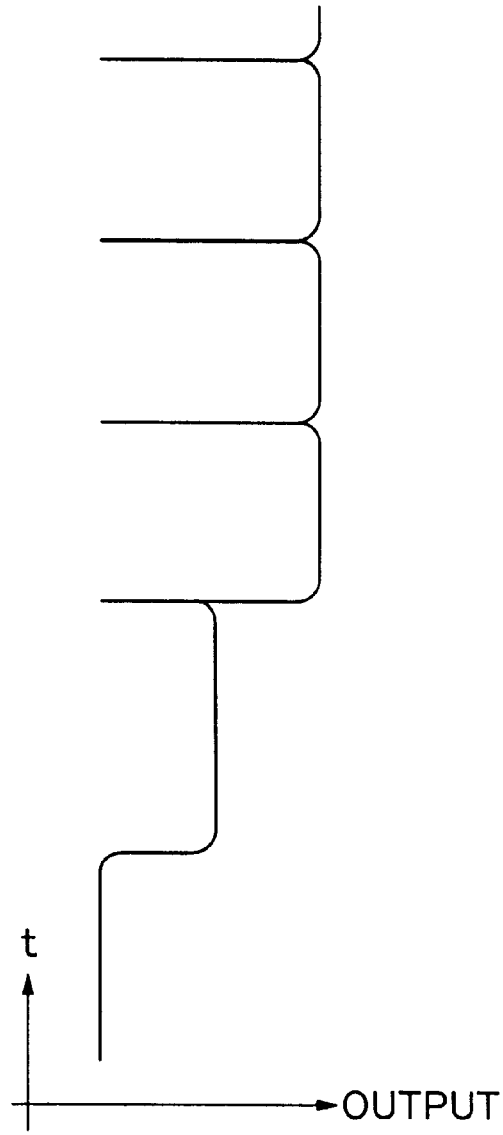

FIGS. 5A and 5B are diagrams showing how the line sensor 32 produces a detected wave with respect to stacked coins wherein FIG. 5A shows the positions of the coin supporting post 18 and coins C and FIG. 5B shows how the line sensor 32 produces a detected wave.

In FIGS. 5A and 5B, t0 designates the time when the coin supporting post 18 has been lowered and the line sensor 32 detects light reflected by the lower end portion of the coin supporting post 18, t1 designates the time when the line sensor 32 detects light reflected by the gap portion between the upper end portion of the coin supporting post 18 and the lower surface of the lowermost coin C, t2 designates the time when the line sensor 32 detects light reflected by the gap portion between the upper end portion of the lowermost coin C and the lower surface of a second coin C stacked on the lowermost coin C, t3 designates the time when the line sensor 32 detects light reflected by the gap portion between the upper end portion of the second coin C and the lower surface of a third coin C stacked on the second coin C, and t4 designates the time when the line sensor 32 detects light reflected by the gap portion between the upper end portion of the third coin C and the lower surface of a fourth coin C stacked on the third coin C, respectively.

Therefore, the reflected light detected by the line sensor 32 between the time t0 and t1 was reflected by the coin supporting post 18 and the reflected light detected by the line sensor 32 between the time t1 and t2, the time t2 and t3 and the time t3 and t4 was reflected by the lowermost coin C, the second coin C and the third coin C, respectively.

The edge of coin C is often formed with milling. However, even when the edge of coin C is formed with uneven portions, if the denomination of coins C is the same, the total amounts of the light reflected from the side surfaces of coins C and detected by the line sensor 32 are substantially the same. To the contrary, since the obverse and reverse surfaces of a coin C are generally formed with uneven portions and adjacent coins C are in contact with each other with uneven portions thereof formed on the surfaces so that a gap portion is present between the adjacent coins C, the amount of light reflected by the portion of the adjacent coins C is less than that reflected by the edge of a coin C. Further, the diffusion reflection on the uneven portions of the obverse and reverse surfaces of coins C tends to occur. Therefore, the amount of light reflected by the portion between the adjacent coins C and received by the light receiving elements of the line sensor 32 is much less than that reflected by the edge of a coin C and received by the light receiving elements of the line sensor 32. Accordingly, when the line sensor 32 receives light reflected by the portion between adjacent coins C, as shown in FIG. 5B, since the output level of the waveform output from the line sensor 32 is markedly lowered, the number of the portions between adjacent coins C can be detected based on the waveform output from the line sensor 32 and the number of the stacked coins supported on the coin supporting post 18 can be determined based on the number of the portions between adjacent coins C. Since the diameter of the coin supporting post 18 is determined to be smaller than the diameter of the smallest coins to be wrapped, the amount of light reflected by vertical unit length of the coin supporting post 18 and detected by the line sensor 32 is less than the amount of light reflected by vertical unit length of the side surface of a coin C and detected by the line sensor 32. Therefore, it is possible to distinguish the coin supporting post 18 and a coin C based on the waveform output from the line sensor 32. The sampling period for reflected light by the line sensor 32 has to be determined so as to enable detection of the portion between adjacent coins C. More specifically, assuming that the lowering velocity of the coin supporting post 18 is V and the narrowest width of a portion between adjacent coins C to be wrapped is W, the sampling period for reflected light by the line sensor 32 has to be determined to be equal to or shorter than $\Delta t=W/V$.

As the coin supporting post 18 is lowered, the detected waveform shown in FIG. 5B is output from the line sensor 32. The CPU 40 uses a threshold value T to binarize detected data of reflected light input from the line sensor 32 into an H signal and an L signal and detects the number of the portions between the adjacent coins C based on the binarized data, thereby determining the number of coins C supported on the coin supporting post 18.

Figure 6A:
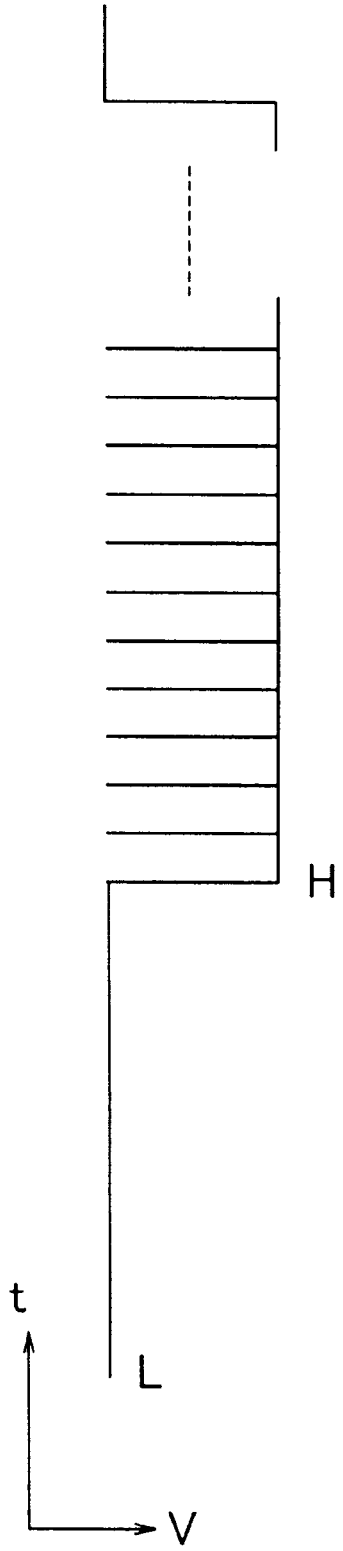
FIGS. 6A and 6B are diagrams showing detection data binarized by a CPU.
Figure 6B:
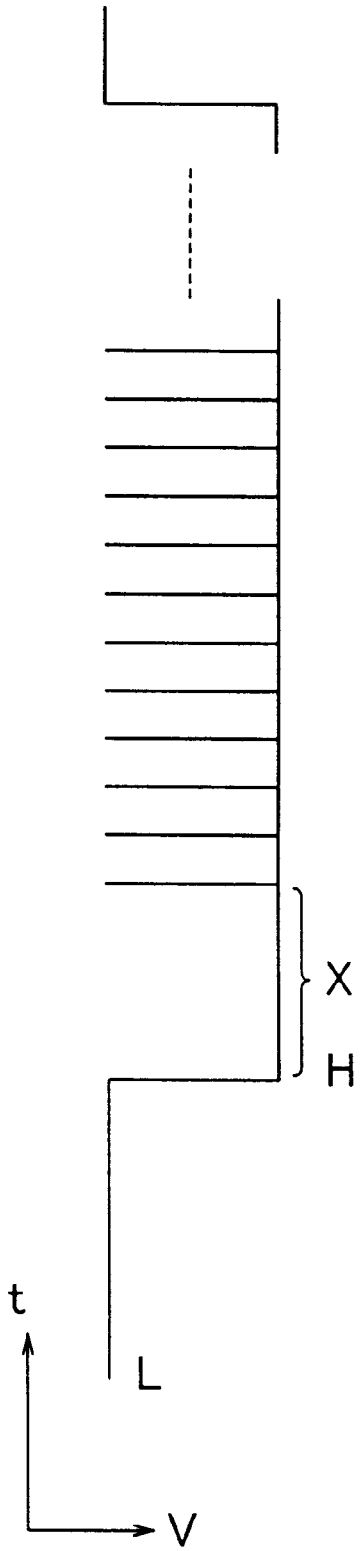

FIGS. 6A and 6B are diagrams showing detection data binarized by the CPU 40. FIG. 6A shows binarized data when the threshold value T is set to be greater than the level of the amount of received light reflected from the coin supporting post 18 and FIG. 6B shows binarized data when the threshold value T is set to be lower than the level of the amount of received light reflected from the coin supporting post 18.

As shown in FIG. 6A, when the threshold value T is set to be greater than the level of the amount of received light reflected from the coin supporting post 18, it is possible to easily detect the number of portions between adjacent coins C and determine the number of coins C supported on the coin supporting post 18. However, in the case where the difference between the diameter of the smallest coins C to be wrapped and that of the coin supporting post 18 is small, even when the threshold value T is set to be greater than the level of the amount of received light reflected from the coin supporting post 18 and lower than that of received light reflected from the side surface of the smallest coin C to be wrapped, the CPU 40 may judge that the level of the amount of received light reflected from the coin supporting post 18 is greater than the threshold value T for some reasons and, as shown in FIG. 6B, binarize it to an H signal. Therefore, the coin wrapping machine according to this embodiment is constituted so as to accurately determine the number of coins C supported on the coin supporting post 18. More specifically, there is stored in the ROM 41 in advance a reference time period value equal to a value X0 produced by adding a predetermined time period $\delta t$ to the time period during which an H signal is input from the line sensor 32 to the CPU 40 when light emitted from the light source 30 is projected onto the edge of the thickest coin C to be wrapped and the light reflected therefrom is detected by the line sensor 32. When a detection signal is input from the line sensor 32, the CPU 40 reads out the reference time period data from the ROM 41. The CPU 40 then detects the time period X from the time when an H signal was input to the time when an L signal is input and judges whether or not the time period X is longer than the reference time period value X0 read out from the ROM 41. If the time period X is not longer than the reference time period value X0, the CPU 40 judges that the H signal was produced by detecting light reflected from the edge of a coin C and determines the number of coins C supported on the coin supporting post 18 by counting the number of L signals thereafter input. To the contrary, if, as shown in FIG. 6B, the time period X is longer than the reference time period value X0, since it can be considered that the H signal was produced by detecting light reflected from the side surface of the coin supporting post 18, the CPU 40 judges that the L signal first input was produced by detecting light reflected from the portion between the upper surface of the coin supporting post 18 and the lower surface of the lowermost coin C and determines the number of coins C supported on the coin supporting post 18 by counting the number of L signals thereafter input.

When time period during which the CPU 40 is detecting an L signal thereafter input is longer than the reference time period data X0, since it can be considered that the detection of the coins C supported on the coin supporting post 18 has been completed, the CPU 40 reads out the number of coins C to be wrapped and stored in the ROM 41 in advance and compares it with the counted value of the number of coins C supported on the coin supporting post 18, thereby judging whether or not the predetermined number of coins C are stacked and supported on the coin supporting post 18.

When the counted value of the number of coins C does not coincide with the number of coins C to be wrapped, the CPU 40 stores in the RAM 42 an instruction that the coin wrapping should not be effected. On the other hand, when the counted value of the number of coins C coincides with the number of coins C to be wrapped, the CPU 40 outputs no instruction to the RAM 42.

When the coin supporting post 18 supporting the stacked coins C has been lowered to the wrapping position, the CPU 40 accesses the RAM 42 and judges whether or not an instruction that the coin wrapping should not be effected is stored in the RAM 42. When an instruction that the coin wrapping should not be effected is not stored in the RAM 42, the CPU 40 outputs a driving signal to the motor 58 to rotate the wrapping paper feeding roller 22, thereby feeding the leading end of the wrapping paper 17 into a space between the wrapping rollers 16 and the coins C stacked and supported on the coin supporting post 18. The CPU 40 then outputs a driving signal to the cam motor 55 for a predetermined time period to move the wrapping rollers 16 close to each other, thereby causing the wrapping rollers 16 to hold the coins C supported on the coin supporting post 18 therebetween via the wrapping paper 17. The CPU 40 further outputs a driving signal to the motor 56 to rotate the wrapping rollers 16, thereby winding the wrapping paper 17 around the stacked coins held by the wrapping rollers 16 therebetween. When a predetermined length of the wrapping paper 17 has been fed to a portion between the wrapping rollers 16 and the stacked coins, the wrapping paper 17 is cut by the cutter 23.

After the wrapping paper 17 has been wound around the stacked coins, the CPU 40 outputs a driving signal to the cam motor 55 for a predetermined time period, thereby moving the upper crimp claw 25 and the lower crimp claw 26 to between the wrapping rollers 16 and then moving them toward the upper and lower surfaces of the stacked coins so that the upper and lower end portions of the wrapping paper 17 are crimped by the upper crimp claw 25 and the lower crimp claw 26 to produce a wrapped coin roll.

The CPU 40 then outputs a driving signal to the cam motor 55 for a predetermined time period, thereby moving the upper crimp claw 25 and the lower crimp claw 26 apart from the upper and lower surfaces of the stacked coins, from between the wrapping rollers 16 to the outside, and simultaneously moving the coin supporting post 18 to the retracted position and the wrapping rollers 16 apart from each other.

The thus produced wrapped coin roll is fed to a wrapped coin roll box (not shown) via a gate 46 and a chute (not shown).

To the contrary, when an instruction that the coin wrapping should not be effected is stored in the RAM 42, the CPU 40 does not output any driving signal to the motor 58 but outputs a driving signal to the cam motor 55 for a predetermined time period to move the wrapping rollers 16 close to each other, thereby causing the wrapping rollers 16 to hold the coins C supported on the coin supporting post 18 therebetween. The CPU 40 simultaneously outputs a driving signal to the solenoid 59, thereby preventing the upper crimp claw 25 and the lower crimp claw 26 from moving to between the wrapping rollers 16 even when the cam motor 55 is driven and outputs a driving signal to the solenoid 60, thereby switching the gate 46 so as to communicate with a collecting box (not shown). Afterward, the CPU 40 outputs a driving signal to the cam motor 55 for a predetermined time period, thereby moving the coin supporting post 18 to the retracted position and moving the wrapping rollers 16 apart from each other.

As a result, in the case where the number of coins stacked on the coin supporting post 16 does not coincide with the number of coins C to be wrapped, the coins C are collected in a collecting box (not shown) via the switched gate 46.

According to this embodiment, it is judged whether or not the number of stacked coins supported on the coin supporting post 16 coincides with the number of coins C to be wrapped by projecting light emitted from the light source 30 onto the stacked coins supported on the coin supporting post 18 via the slit 31, converging light reflected by the edges of the coins C onto the light receiving elements of the line sensor 32 by the cylindrical lens 33 and analyzing a detected wave form output from the line sensor 32. Further, the light source 30, the slit 31, the cylindrical lens 33 and the line sensor 32 are disposed in the same horizontal plane between the coin stacking section 7 and the coin wrapping section 15. Therefore, without making the coin wrapping machine large, it is possible to provide means for detecting the number of coins stacked in the coin stacking section 7 and being transferred to the coin wrapping section 15 even when guide members (not shown) for guiding the wrapping paper 17 between the three wrapping rollers 16 and coins to be wrapped are provided and it is extremely difficult to secure a space for detecting the number of coins to be wrapped in the coin wrapping section 15, thereby reliably producing wrapped coin rolls each including the predetermined number of coins C.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although light reflected by the edges of coins C is detected by the line sensor 32 including a plurality of light receiving elements disposed horizontally, a single light receiving element may be provided instead of the line sensor 32 to detect the reflected light.

Further, in the above described embodiment, although the coin supporting post 18 is detected based on the wave form output from the line sensor 40, the coin supporting post 18 may be detected based on the rotation amount of the cam motor 55.

Moreover, in the above described embodiment, the light source 30, the slit 31, the cylindrical lens 33 and the line sensor 32 are disposed in the same horizontal plane between the coin stacking section 7 and the coin wrapping section 15. However, if considerations permit, they may be disposed at different positions in the vertical direction.

Further, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin wrapping machine which is compact and can reliably produce wrapped coin rolls each including a predetermined number of coins.

What is claimed is:

1. A coin wrapping machine comprising:

coin stacking means for stacking deposited coins, coin wrapping means for wrapping coins stacked by the coin stacking means, stacked coin moving means for supporting and moving the stacked coins from the coin stacking means to the coin wrapping means, light projecting means disposed between the coin stacking means and the coin wrapping means for projecting light onto the stacked coins being moved from the coin stacking means to the coin wrapping means, light detecting means disposed between the coin stacking means and the coin wrapping means for photoelectrically detecting light impinging onto the stacked coins from the light projecting means and reflected by edges of the stacked coins, and coin number determining means for detecting portions between adjacent coins based on detection data produced by the light detecting means, thereby determining the number of the stacked coins supported by the stacked coin moving means.

2. A coin wrapping machine in accordance with claim 1 wherein the light projecting means and the light detecting means are disposed in the same horizontal plane.

3. A coin wrapping machine in accordance with claim 1 wherein the light detecting means comprises a plurality of light receiving elements disposed horizontally.

4. A coin wrapping machine in accordance with claim 2 wherein the light detecting means comprises a plurality of light receiving elements disposed horizontally.

5. A coin wrapping machine in accordance with claim 1 wherein the coin number determining means is constituted so as to binarize the detection data produced by the light detecting means and detect the portions between adjacent coins based on the thus binarized data.

6. A coin wrapping machine in accordance with claim 2 wherein the coin number determining means is constituted so as to binarize the detection data produced by the light detecting means and detect the portions between adjacent coins based on the thus binarized data.

7. A coin wrapping machine in accordance with claim 3 wherein the coin number determining means is constituted so as to binarize the detection data produced by the light detecting means and detect the portions between adjacent coins based on the thus binarized data.

8. A coin wrapping machine in accordance with claim 4 wherein the coin number determining means is constituted so as to binarize the detection data produced by the light detecting means and detect the portions between adjacent coins based on the thus binarized data.

9. A coin wrapping machine in accordance with claim 5 wherein the coin number determining means is constituted so as to judge whether light detected by the light detecting means was reflected by an edge of a stacked coin in accordance with reference data produced based on thickness of the thickest coins to be wrapped.

10. A coin wrapping machine in accordance with claim 6 wherein the coin number determining means is constituted so as to judge whether light detected by the light detecting means was reflected by an edge of a stacked coin in accordance with reference data produced based on thickness of the thickest coins to be wrapped.

11. A coin wrapping machine in accordance with claim 7 wherein the coin number determining means is constituted so as to judge whether light detected by the light detecting means was reflected by an edge of a stacked coin in accordance with reference data produced based on thickness of the thickest coins to be wrapped.

12. A coin wrapping machine in accordance with claim 8 wherein the coin number determining means is constituted so as to judge whether light detected by the light detecting means was reflected by an edge of a stacked coin in accordance with reference data produced based on thickness of the thickest coins to be wrapped.

* * * * *